US008684774B1

(12) United States Patent
La Salvia et al.

(10) Patent No.: US 8,684,774 B1
(45) Date of Patent: Apr. 1, 2014

(54) WEDGE CONNECTOR ASSEMBLIES AND METHODS AND CONNECTIONS INCLUDING SAME

(71) Applicant: Tyco Electronics Brasil LTDA, Sao Paolo (BR)

(72) Inventors: Jose Alexandre La Salvia, Sao Jose dos Campos (BR); Vagner Fuzetti, Braganca Paulista (BR)

(73) Assignee: Tyco Electronics Brasil LTDA, Sao Paolo (BR)

( * ) Notice: Subject to any disclaimer, the term of this patent is extended or adjusted under 35 U.S.C. 154(b) by 0 days.

(21) Appl. No.: 14/080,390

(22) Filed: Nov. 14, 2013

Related U.S. Application Data

(62) Division of application No. 13/246,353, filed on Sep. 27, 2011, now Pat. No. 8,608,517.

(51) Int. Cl.
*H01R 4/50* (2006.01)

(52) U.S. Cl.
USPC ..... 439/783; 439/864

(58) Field of Classification Search
USPC ..... 439/783, 760, 863, 864
See application file for complete search history.

(56) References Cited

U.S. PATENT DOCUMENTS

| | | | | |
|---|---|---|---|---|
| 4,057,878 | A | 11/1977 | Kaye | 24/134 R |
| 4,059,333 | A | 11/1977 | Mixon, Jr. | |
| 4,279,461 | A | 7/1981 | Bussen et al. | |
| 4,624,519 | A | 11/1986 | Lawrence | 439/410 |
| 4,722,189 | A | 2/1988 | Center | |
| 4,723,920 | A | 2/1988 | Werner | 439/782 |
| 4,734,062 | A | 3/1988 | Goto | 439/783 |
| RE33,098 | E | 10/1989 | Center | |
| 4,905,603 | A | 3/1990 | McBain | |
| 4,915,279 | A | 4/1990 | Galbraith | |
| 5,090,923 | A | 2/1992 | Kenyon et al. | |
| 5,244,422 | A | 9/1993 | Laricchia | |
| 5,538,447 | A | 7/1996 | Chadbourne et al. | |
| 5,624,286 | A | 4/1997 | Marco | 439/786 |
| 5,692,930 | A | 12/1997 | Garver et al. | |
| 5,774,987 | A | 7/1998 | Chadbourne et al. | |
| 5,794,334 | A | 8/1998 | Chadbourne et al. | |
| 5,862,589 | A | 1/1999 | Chadbourne et al. | |
| 6,093,064 | A | 7/2000 | Callen et al. | |

(Continued)

FOREIGN PATENT DOCUMENTS

GB 2 311 664 A 10/1997

OTHER PUBLICATIONS

"U.D.C.—Universal Distribution Connector Reinforced," Tyco Electronics Catalog 125003, Revised Mar. 1999, 8 pages.

(Continued)

*Primary Examiner* — Khiem Nguyen
(74) *Attorney, Agent, or Firm* — Myers Bigel Sibley & Sajovec, PA

(57) ABSTRACT

A wedge connector assembly for forming an electrical connection with an elongate electrical conductor includes a resilient spring member and a cam wedge member. The spring member defines a spring member channel. The spring member channel has a spring member channel axis and is configured to receive the electrical conductor such that the electrical conductor extends along the spring member channel axis. The cam wedge member is mounted on the spring member such that the cam wedge member is rotatable relative to the spring member about a pivot axis to a locking position wherein the cam wedge member captures the electrical conductor in the spring member channel and elastically deflects the spring member.

19 Claims, 14 Drawing Sheets

(56) References Cited

U.S. PATENT DOCUMENTS

| | | | |
|---|---|---|---|
| 6,116,969 | A | 9/2000 | Piriz |
| 6,120,334 | A | 9/2000 | Timsit et al. |
| 6,517,391 | B1 | 2/2003 | Chadbourne |
| 6,851,262 | B1 | 2/2005 | Gregory et al. |
| 7,182,653 | B1 | 2/2007 | Hoxha |
| 7,309,263 | B2 | 12/2007 | Copper et al. |
| 7,387,546 | B2 | 6/2008 | Copper et al. |
| 7,426,782 | B2 | 9/2008 | Johnson et al. |
| 7,494,385 | B2 | 2/2009 | Copper et al. |
| 7,524,217 | B2 | 4/2009 | Copper et al. |
| D599,184 | S | 9/2009 | Johnson et al. |
| 7,677,933 | B2 | 3/2010 | Copper et al. |
| 7,686,661 | B2 | 3/2010 | Shrum et al. |
| 7,736,203 | B2 | 6/2010 | Copper et al. |
| 7,819,706 | B2 | 10/2010 | Copper et al. |
| 7,845,990 | B2 | 12/2010 | Shrum et al. |
| 7,862,390 | B2 | 1/2011 | Copper |
| 2010/0011571 | A1 | 1/2010 | Copper et al. |
| 2010/0015862 | A1 | 1/2010 | Gregrory et al. |
| 2010/0227512 | A1 | 9/2010 | Copper et al. |
| 2011/0028052 | A1 | 2/2011 | Copper et al. |

OTHER PUBLICATIONS

"Ready Reference Guide," Tyco Electronics, Energy Division, http://energy.tycoelectronics.com, 143 pages.

"General Catalog, " Grupo Intelli, www.grupointelli.com, IntMKT Set/2009, 52 pages.

AMP Customer Manual, *AMPACT Taps, Stirrups and Application Tooling*, #409-2106, Feb. 5, 1999, Rev. M (39 pages).

Notification of Transmittal of the International Search Report and Written Opinion of the International Searching Authority, or the Declaration in corresponding PCT Application No. PCT/IB2012/001902, mailed Jan. 22, 2013 (13 pages).

WEDGE CONNECTOR ASSEMBLIES AND METHODS AND CONNECTIONS INCLUDING SAME

RELATED APPLICATION(S)

The present application is a divisional of and claims priority from U.S. patent application Ser. No. 13/246,353, filed Sep. 27, 2011, the disclosure of which is incorporated herein by reference in its entirety.

FIELD OF THE INVENTION

The present invention relates to electrical connectors and, more particularly, to power utility electrical connectors and methods and connections including the same.

BACKGROUND OF THE INVENTION

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, four types of connectors are commonly used for such purposes, namely bolt-on connectors, compression-type connectors, wedge connectors, and transverse wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors.

Compression connectors, instead of utilizing separate connector pieces, may include a single metal piece connector that is bent or deformed around the main power conductor and the tap conductor to clamp them to one another.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from TE Connectivity and is known as an AMPACT Tap or Stirrup Connector. AMPACT connectors include different sized channel members to accommodate a set range of conductor sizes, and multiple wedge sizes for each channel member. Each wedge accommodates a different conductor size.

Exemplary transverse wedge connectors are disclosed in U.S. Pat. Nos. 7,862,390, 7,845,990, 7,686,661, 7,677,933, 7,494,385, 7,387,546, 7,309,263, 7,182,653 and U.S. Patent Publication Nos. 2010/0015862 and 2010/0011571.

SUMMARY OF THE INVENTION

According to embodiments of the present invention, a wedge connector assembly for forming an electrical connection with an elongate electrical conductor includes a resilient spring member and a cam wedge member. The spring member defines a spring member channel. The spring member channel has a spring member channel axis and is configured to receive the electrical conductor such that the electrical conductor extends along the spring member channel axis. The cam wedge member is mounted on the spring member such that the cam wedge member is rotatable relative to the spring member about a pivot axis to a locking position wherein the cam wedge member captures the electrical conductor in the spring member channel and elastically deflects the spring member.

According to method embodiments of the present invention, a method for forming an electrical connection with an elongate electrical conductor includes providing a wedge connector assembly including: a resilient spring member defining a spring member channel, the spring member channel having a spring member channel axis; and a cam wedge member mounted on the spring member such that the cam wedge member is rotatable relative to the spring member about a pivot axis. The method further includes: mounting the electrical conductor in the spring member channel such that the electrical conductor extends along the spring member channel axis; and rotating the cam wedge member about the pivot axis to a locking position wherein the cam wedge member captures the electrical conductor in the spring member channel and elastically deflects the spring member.

According to embodiments of the present invention, an electrical connection includes a wedge connector assembly and an elongate electrical conductor. The wedge connector assembly includes a resilient spring member and a cam wedge member. The spring member defines a spring member channel. The spring member channel has a spring member channel axis. The cam wedge member is mounted on the spring member such that the cam wedge member is rotatable relative to the spring member about a pivot axis. The electrical conductor is received in the spring member channel and extends along the spring member channel axis. The cam wedge member is rotated about the pivot axis to a locking position wherein the cam wedge member captures the electrical conductor in the spring member channel and elastically deflects the spring member.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
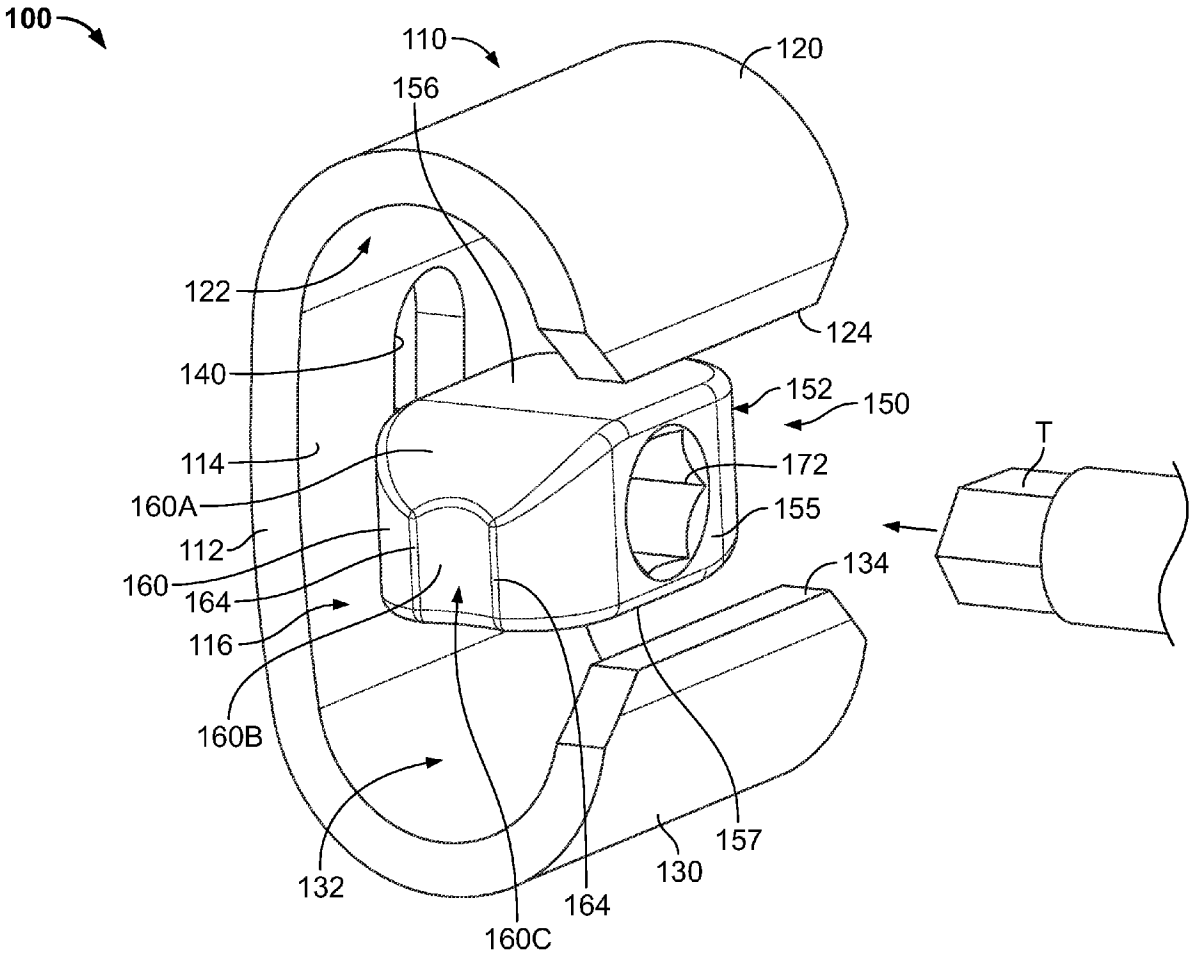
FIG. 1 is left, front perspective view of a wedge connector assembly according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-6, a wedge connector assembly 100 according to embodiments of the present invention is shown therein. The connector assembly 100 can be used to form a connection 5 (FIG. 6) including a pair of elongate electrical conductors 12, 14 (e.g., electrical power lines) mechanically and electrically coupled by the connector assembly 100. The connector assembly 100 may be adapted for use as a tap connector for connecting an elongate tap conductor 12 to an elongate main conductor 14 of a utility power distribution system, for example.

The tap conductor 12, sometimes referred to as a distribution conductor, may be a known electrically conductive metal high voltage cable or line having a generally cylindrical form in an exemplary embodiment. The main conductor 14 may also be a generally cylindrical high voltage cable line. The tap conductor 12 and the main conductor 14 may be of the same wire gage or different wire gage in different applications and the connector assembly 100 is adapted to accommodate a range of wire gages for each of the tap conductor 12 and the main conductor 14. The conductor 12 has a lengthwise axis B-B and the conductor 14 has a lengthwise axis A-A.

When installed to the tap conductor 12 and the main conductor 14, the connector assembly 100 provides electrical connectivity between the main conductor 14 and the tap conductor 12 to feed electrical power from the main conductor 14 to the tap conductor 12 in, for example, an electrical utility power distribution system. The power distribution system may include a number of main conductors 14 of the same or different wire gage, and a number of tap conductors 12 of the same or different wire gage.

With reference to FIG. 1, the connector assembly 100 includes a sleeve member or spring member 110 and a spin or cam wedge member 150. The spring member 110 and the cam wedge member 150 are movable relative to one another to cooperatively mechanically capture the conductors 12, 14 therebetween and electrically connect the conductors 12, 14 to one another.

The spring member 110 is resiliently flexible. The spring member 110 is C-shaped in cross-section and includes a first receiver or hook portion 120, a second receiver or hook portion 130, and a connecting or central portion 112 extending therebetween. The spring member 110 further includes an inner surface 114. The spring member 110 forms a chamber 116 defined by the inner surface 114.

The first hook portion 120 forms a first spring member, cradle or channel 122 positioned at an end of the chamber 116. The first channel 122 is adapted to receive and make contact with the conductor 14 at an apex of the channel 122. A distal end 124 of the first hook portion 120 includes a radial bend that wraps around the conductor 14 for about 180 circumferential degrees in an exemplary embodiment, such that the distal end 124 faces toward the second hook portion 130. Similarly, the second hook portion 120 forms a second spring member, cradle or channel 132 positioned at an opposing end of the chamber 116. The second channel 132 is adapted to receive and make contact with the conductor 12 at an apex of the channel 132. A distal end 134 of the second hook portion 130 includes a radial bend that wraps around the conductor 12 for about 180 circumferential degrees in an exemplary embodiment, such that the distal end 134 faces toward the first hook portion 120. The distal ends 124 and 134 define a slot therebetween that opens into and provides access to the chamber 116.

Figure 2:
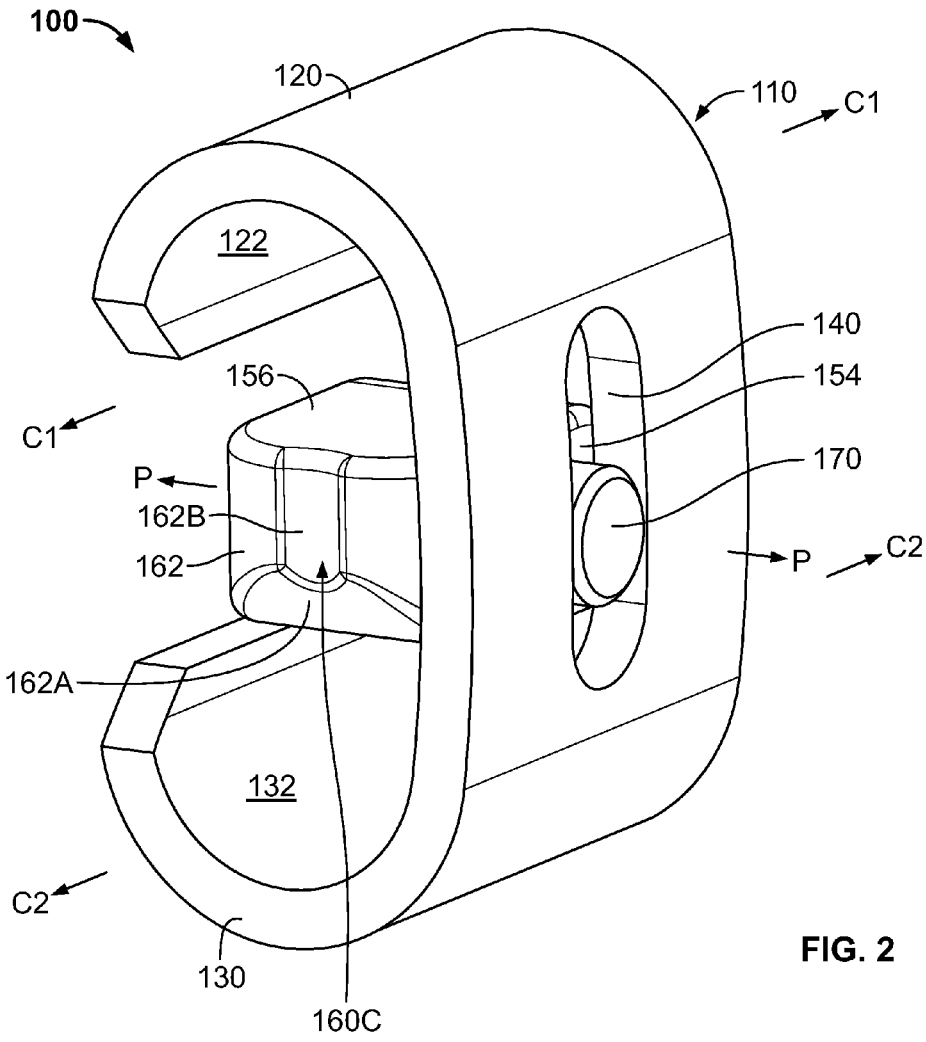
FIG. 2 is a right, rear perspective view of the wedge connector assembly of FIG. 1.
Figure 3:
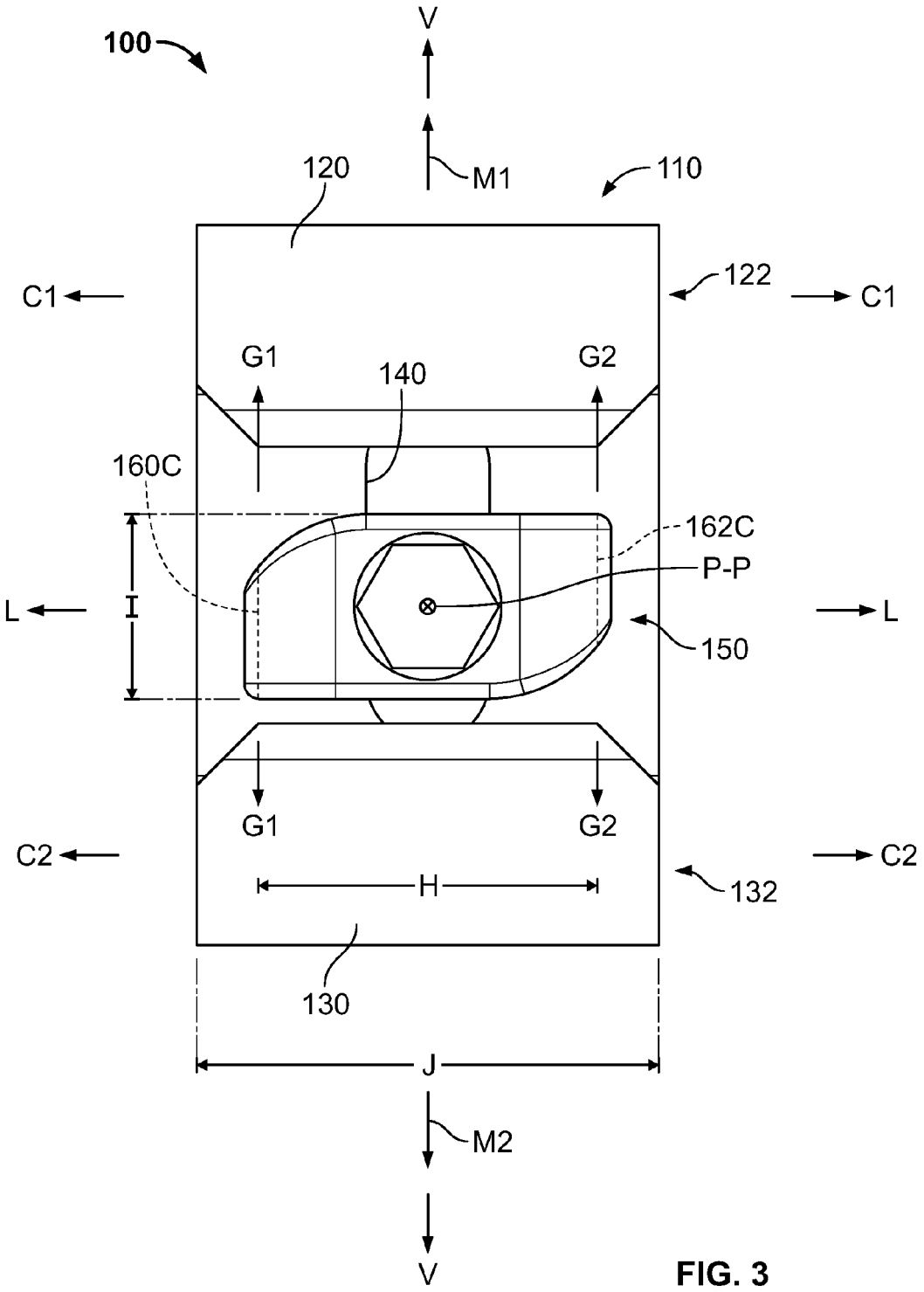
FIG. 3 is a front plan view of the wedge connector assembly of FIG. 1.

With reference to FIGS. 2 and 3, the spring member 110 has a lengthwise axis L-L (FIG. 3). The first channel 122 defines a first channel axis C1-C1. The second channel 122 defines a second channel axis C2-C2. According to some embodiments and as illustrated, the channel axes C1-C1 and C2-C2 are substantially parallel to one another. According to some embodiments and as illustrated, the channel axes C1-C1 and C2-C2 are substantially parallel to the lengthwise axis L-L. The spring member 110 also has a transverse axis V-V extending transversely to and intersecting each of the channel axes C1-C1 and C2-C2. According to some embodiments and as illustrated, the transverse axis V-V (FIG. 3) is substantially perpendicular to each of the channel axes C1-C1 and C2-C2.

A cam slot 140 is defined in the central portion 112 and extends substantially parallel to the transverse axis V-V.

The cam wedge member 150 includes a body 152 defined by an inner side 154 (FIG. 2), an outer side 155, a top side 156, a bottom side 157, a first end 160 (FIG. 1), and a second end 162 (FIG. 2) opposed to the first end 160. The cam wedge member 150 is disposed in the chamber 116 between the hook portions 120, 130.

A rotation guide feature in the form of a pivot post 170 (FIG. 2) extends outwardly from the inner side 154. The inner side 154 faces the central portion 112 and the pivot post 170 is slidably received in the cam slot 140. The cam wedge member 150 is slidable in an upward direction (FIG. 3) M1 and an opposing downward direction M2 with respect to the spring member 110 along the slot 140. The cam wedge member 150 is also pivotable or rotatable about a pivot axis P-P that, in the illustrated embodiment, is defined or limited by the engagement between the cam slot 140 and the pivot post 170. The pivot axis P-P is transverse to the channel axes C1-C1, C2-C2 and the transverse axis V-V. According to some embodiments and as illustrated, the pivot axis P-P is perpendicular to the channel axes C1-C1, C2-C2. According to some embodiments and as illustrated, the pivot axis P-P is also perpendicular to the transverse axis V-V. According to some embodiments, the position of the pivot axis P-P along the transverse axis V-V is variable or relocatable depending on the sizes of the conductors 12, 14.

A driver engagement feature in the form of a geometric socket 172 (e.g., a hexagonal Allen driver socket) is provided in the outer side 155. According to some embodiments and as illustrated, the socket 172 is accessible for engagement with a driver T (FIG. 1) through the slot defined between the distal ends 124, 134.

Figure 6:
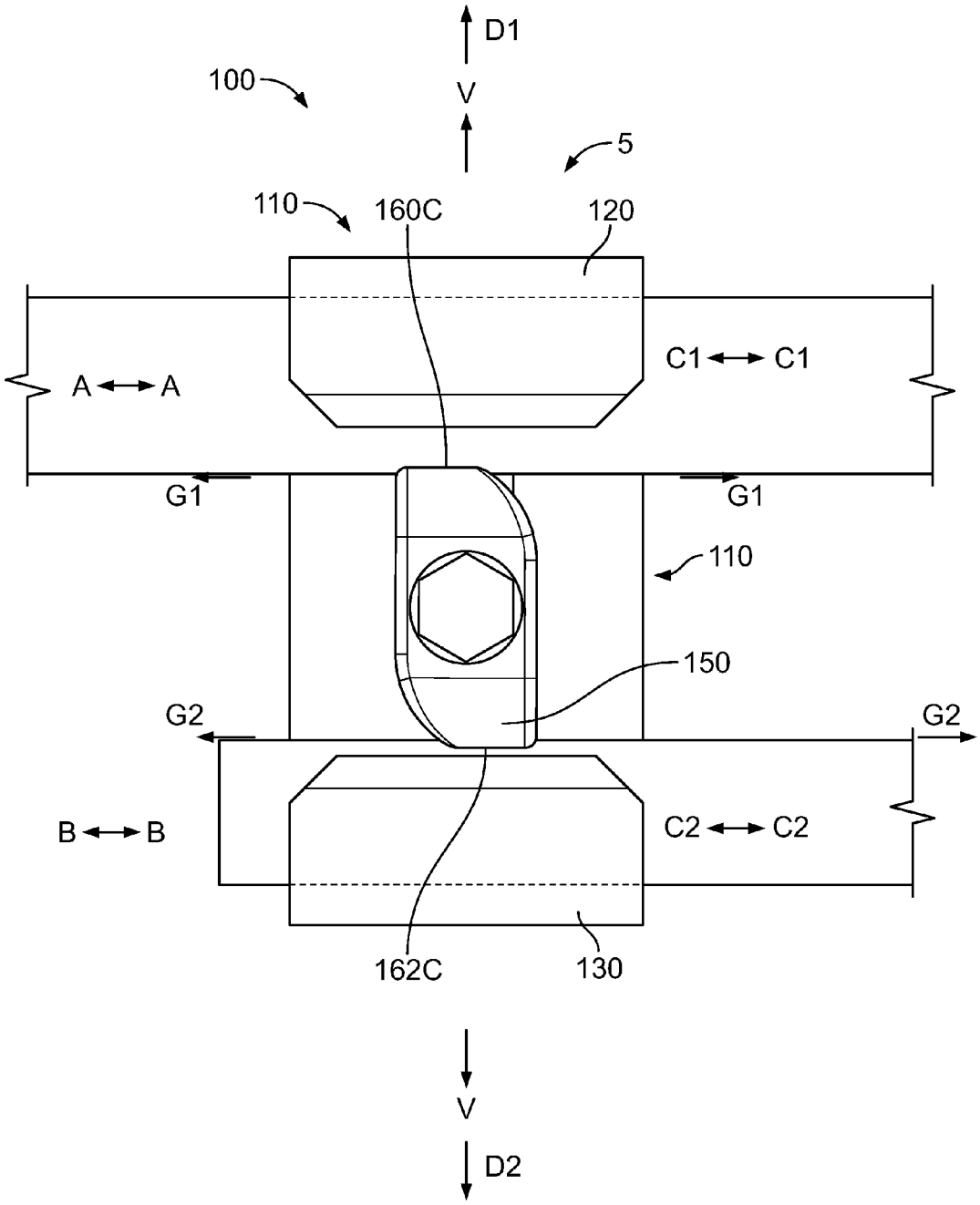

A first ramp surface 160A (FIG. 1) transitions the top side 156 to the first end 160. A second ramp surface 162A (FIG. 2) transitions the bottom side 157 to the second end 162. A first inwardly extending indentation or groove 160B (FIG. 1) is located in the first end 160 and may intersect the first ramp surface 160A. A second inwardly extending indentation or groove 162B (FIG. 2) is located in the second end 162 and may intersect the second ramp surface 162A. The first groove 160B and the second groove 162B define a first conductor receiving wedge member channel 160C and a second conductor receiving wedge member channel 162C, respectively. The channels 160C, 162C have a predetermined radius that cups the conductors 12, 14 to position the conductors 12, 14 with respect to the spring member 110. With reference to FIGS. 3 and 6, the first conductor receiving channel 160C defines an axis G1-G1 and the second conductor receiving channel 162C defines an axis G2-G2.

The formation and geometry of the wedge member 150 provides for interfacing with differently sized conductors 12, 14 while achieving a repeatable and reliable interconnection of the wedge member 150 and the conductors 12, 14. In an exemplary embodiment, lips 164 (FIG. 1) of the channels 160C, 162C are spaced apart to accommodate differently sized conductors 12, 14. In some embodiments, the channels 160C, 162C are substantially identically formed and share the same geometric profile and dimensions to facilitate capturing of the conductors 12 and 14 between the wedge member 150 and the spring member 110 during mating. The channels 160C, 162C, however, may be differently dimensioned as appropriate to be engaged to differently sized conductors 12, 14 while maintaining substantially the same shape of the wedge member 150. In an exemplary embodiment, the depths of the channels 160C, 162C are selected to be less than one half of the diameter of the conductors 14 and 12. As such, the ends 160, 162 do not interfere with the spring member 110, thus the force of the spring member 110 is applied entirely to the conductors 12 and 14.

With reference to FIG. 3, the distance H between the apexes of the channels 160C, 162C is greater than the distance I between the upper and lower sides 156, 157. According to some embodiments, the distance H is at least 150 percent of the distance I.

The cam wedge member 150 and the spring member 110 may be separately fabricated from one another or otherwise formed into discrete connector components and are assembled to one another as explained below. While exemplary shapes of the wedge 150 and spring member 110 have been illustrated herein, it is recognized that the members 110, 150 may be alternatively shaped in other embodiments as desired.

The spring member 110 may be formed of any suitable electrically conductive material. According to some embodiments, the spring member 110 is formed of metal. According to some embodiments, the spring member 110 formed of aluminum or steel. The spring member 110 may be formed using any suitable technique. According to some embodiments, the spring member 110 is monolithic and unitarily formed. According to some embodiments, the spring member 110 is extruded and cut. Alternatively or additionally, the spring member 110 may be stamped (e.g., die-cut), cast and/or machined.

The cam wedge member 150 may be formed of any suitable electrically conductive material. According to some embodiments, the cam wedge member 150 is formed of metal. According to some embodiments, the cam wedge member 150 is formed of aluminum or steel. The cam wedge member 150 may be formed using any suitable technique. According to some embodiments, the cam wedge member 150 is monolithic and unitarily formed. According to some embodiments, the cam wedge member 150 is cast. Alternatively or additionally, the wedge member 150 may be stamped (e.g., die-cut), extruded and cut, and/or machined.

Figure 4:
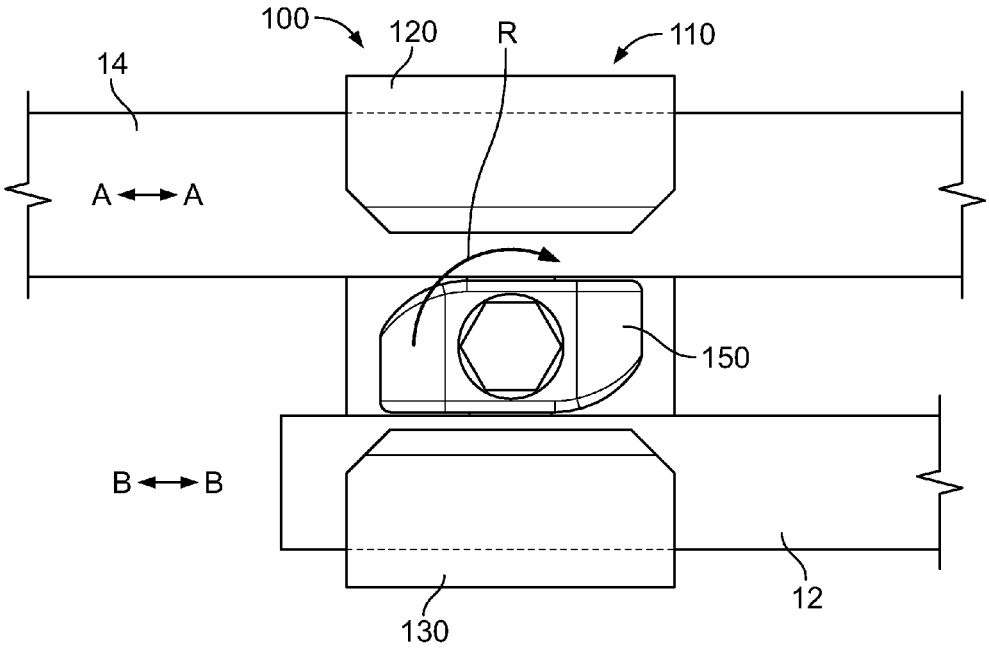
FIGS. 4-6 are front plan views illustrating methods for installing the wedge connector assembly of FIG. 1 on a pair of electrical conductors.
Figure 5:
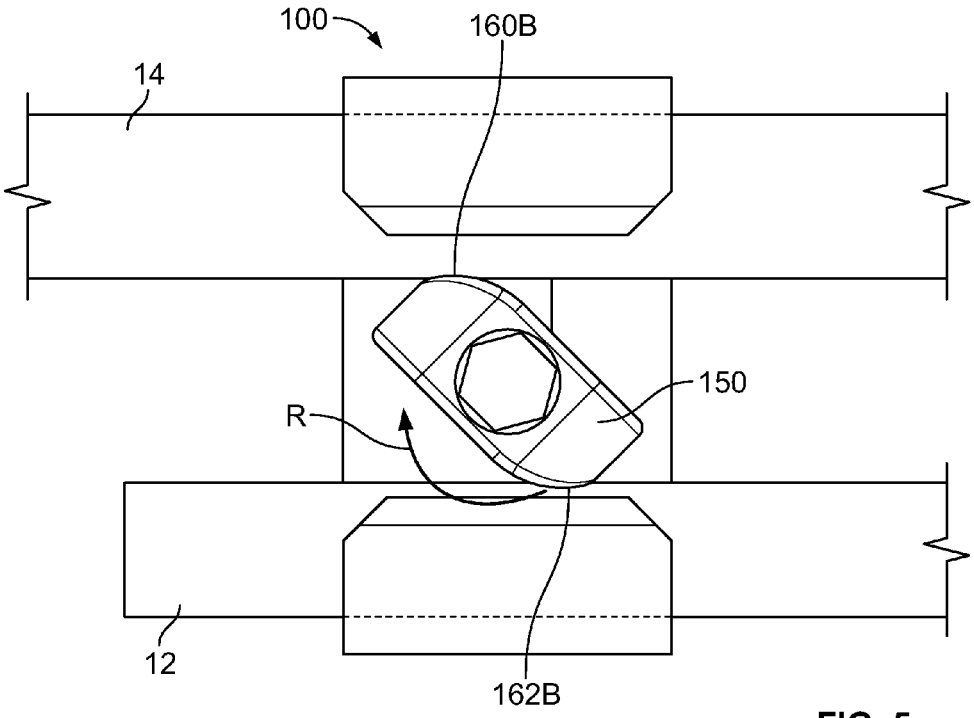

With reference to FIGS. 4-6, exemplary methods for assembling and using the connector assembly 100 in accordance with embodiments of the present invention will now be described.

With the connector assembly 100 configured as shown in FIGS. 1-4 and the cam wedge member 150 in an initial rotational position as shown in FIG. 4, the main conductor 14 and the tap conductor 12 are positioned within the chamber 116 and placed in the channel 122 and the channel 132 (i.e., against the inner surfaces of the first and second hook portions 120 and 130), respectively. The connector assembly 100 may be configured relative to the conductors 12, 14 so that there is substantially no interference between the conductors 12, 14 and the members 110, 150. According to some embodiments, the spring member 110 is not deformed at this time. Alternatively, the hook portions 120, 130 may be partially deflected outward.

The wedge member 150 is then forcibly spun or rotated about the rotation axis P-P in a rotation direction R. As the wedge member 150 is rotated, the ramp surfaces 160B, 162B engage and load or bear against the conductors 14 and 12, respectively, and drive the conductors 14, 12 toward the hook portions 120, 130. The hook portions 120, 130 are thereby displaced or deflected outwardly because the spring member 110 is flexible while the wedge member 150 is solid and the conductors 12, 14 are solid or stranded (semi-solid). FIG. 5 shows the wedge member 150 in an intermediate rotation position.

The forcible spinning or rotation of the wedge member 150 is continued until the wedge member 150 assumes a final or locking position at a rotational stop point as shown in FIG. 6. At the stop point, the connector assembly 100 provides tactile feedback to installer that the locking position has been achieved and, in some embodiments, the wedge member 150 cannot be further rotated in the direction R (absent extreme force). In some embodiments and as illustrated, the amount of rotation between the initial position (FIG. 4) and the locking position (FIG. 6) is about 90 degrees. However, other rotational spacings may be employed.

In the locking position, the conductors 14 and 12 are received in the channels 160C and 162C, respectively, and the conductors 14, 12 are displaced outwardly. In the final mated or locked position, the main conductor 14 is captured between the channel 160C of the wedge member end 160 and the inner surface of the first hook portion 120. Likewise, the tap conductor 12 is simultaneously captured between the channel 162C of the wedge member end 162 and the inner surface of the second hook portion 130. The conductors 12, 14 are thereby prevented from being axially displaced with respect to one another and the connector assembly 100.

The wedge member 150 can dynamically slide up and down the cam slot 140 to relocate along the axis V-V as needed to accommodate the size differential between the conductors 12, 14, if any.

According to some embodiments, as the wedge member 150 is rotated into the locking position, the hook portions 120, 130 are deflected outward (in directions D1 and D2, respectively) along the axis V-V, as illustrated in FIG. 6 (wherein the initial, non-deformed positions of the hook portions 120, 130 are indicated by dashed lines). The spring member 110 is elastically and plastically deflected resulting in a spring back force (i.e., from stored energy in the bent spring member 110) to provide a clamping force on the conductors 12, 14. As a result of the clamping force, the spring member 110 may generally conform to the conductors 12, 14. According to some embodiments, a large application force, on the order of about 1 to 10 kN of clamping force is provided, and the clamping force ensures adequate electrical contact force and electrical connectivity between the connector assembly 100 and the conductors 12, 14. Additionally, elastic deflection of the spring member 110 provides some tolerance for deformation or compressibility of the conductors 12, 14 over time, such as when the conductors 12, 14 deform due to compression forces. Actual clamping forces may be lessened in such a condition, but not to such an amount as to compromise the integrity of the electrical connection.

According to some embodiments and as illustrated, in the final, installed or locking position, the axes G1-G1, G2-G2 of the wedge member channels 160C, 162C are substantially parallel to the conductor axes A-A, B-B and the spring member channel axes C1-C1, C2-C2. The axes G1-G1, G2-G2 of the wedge member channels 160C, 162C are transverse to, and according to some embodiments and as shown, perpendicular to, the pivot axis P-P and the transverse axis V-V.

Any suitable type or construction of driver T may be used to forcibly rotate the wedge member 150 in the rotation direction R. According to some embodiments, the wedge member 150 is rotated using a power tool. The power tool may be an electrically, pneumatically or hydraulically powered tool. According to some embodiments, the power tool is a battery powered tool. According to some embodiments, the wedge member 150 is rotated using a manual driver.

As the wedge member 150 is rotated, the ramp surfaces 160A, 162A and the grooves 160B, 162B will slide across the conductors 12, 14. This sliding action may serve to friction clean or abrade the conductors 12, 14 to remove oxide layers or other non-conductive layers from the cables 12, 14. This may be particularly beneficial when the conductors 12, 14 are dirty or formed of aluminum. In some embodiments, rough surface features such as serrations or knurls may be provided on the ramp surfaces 160A, 162A and/or the grooves 160B, 162B to assist in abrasion cleaning the conductors 12, 14 and/or improve grip on the conductors 12, 14. Similarly, rough surface features such as serrations or knurls may be provided on the inner surfaces of the hook portions 120, 130 to assist in abrasion cleaning the conductors 12, 14 and/or to improve grip on the conductors 12, 14.

A corrosion inhibitor compound may be provided (i.e., applied at the factory) on the conductor contact surfaces of the wedge member 150 and/or the spring member 110. The corrosion inhibitor may prevent or inhibit corrosion formation and assist in abrasion cleaning of the conductors 12, 14. The corrosion inhibitor can inhibit corrosion by limiting the presence of oxygen at the electrical contact areas. The corrosion inhibitor material may be a flowable, viscous material. The corrosion inhibitor material may be, for example, a base oil with metal particles suspended therein. In some embodiments, the corrosion inhibitor is a cod oil derivative with aluminum nickel alloy particles. Suitable inhibitor materials are available from TE Connectivity. According to some embodiments, the corrosion inhibitor layer has a thickness in the range of from about 0.02 to 0.03 inch.

It will be appreciated that the connector assembly 100 can effectively accommodate conductors 12, 14 of a range or different sizes and configurations as a result of the flexibility of the spring member 110. The capability of the wedge member 150 to move or float along the transverse axis V-V can also enable the connector assembly 100 to adapt to different sizes and configurations of conductors 12, 14. Different connector assemblies 100 can themselves be sized to accommodate different ranges of conductor sizes, from relatively small diameter wires (e.g., from about 8 to 4/0 AWG) for low current applications to relatively large diameter wires (e.g., from about 336.4 to 1192.5 MCM) for high voltage energy transmission applications.

It is recognized that effective clamping force on the conductors 12, 14 is dependent upon the geometry and dimensions of the members 110, 150 and size of the conductors used with the connector assembly 100. Thus, with strategic selections of angles for the engagement surfaces, and the size and positioning of the conductors 12, 14, varying degrees of clamping force may be realized when the connector assembly 100 is used as described above.

According to some embodiments, the radius of curvature of the channels 122, 132 is between about 2 and 30 mm. According to some embodiments, each of the channels 122, 132 extends along an arc of between about 2 and 20 degrees.

According to some embodiments, the ratio of the length J (FIG. 3) of each channel 122, 132 to the outer diameter of the conductor (e.g., conductor 12 or 14) to be received is between about 1.5 and 3.5. According to some embodiments, the depth of the channels 122, 132 is between about 1.0 and 2.0.

As illustrated, the channels 122, 124, 160C, 162C are generally arcuate. However, some or all of the channels 122, 124, 160C, 162C may have cross-sectional shapes of other configurations.

The spring member 110 can be provided with intermediate bends (e.g., corresponding to the bends 219 described below) to increase the mechanical resistance to deflection while the spring member 110 still remains flexible and resilient.

Figure 7:
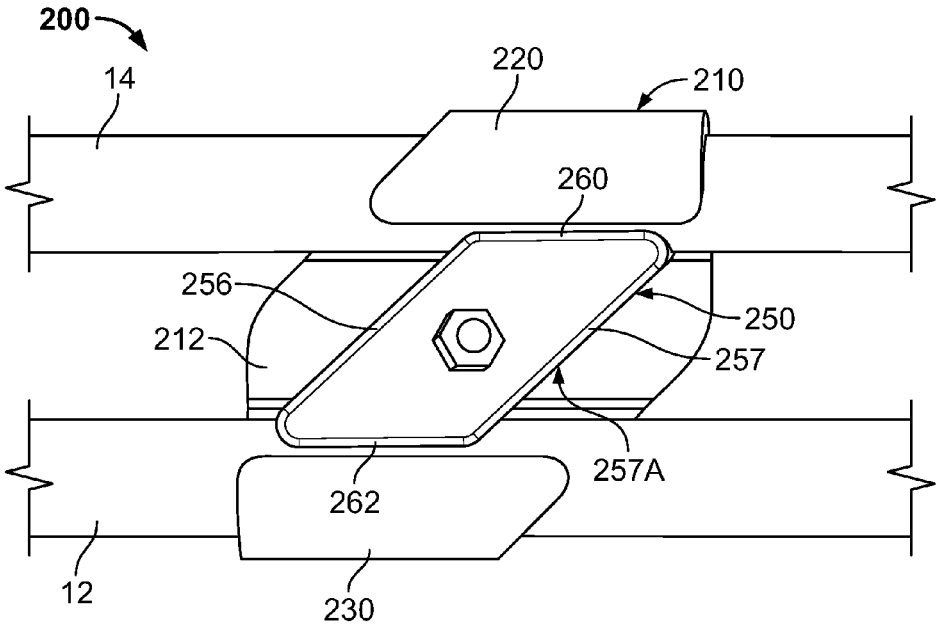
FIG. 7 is a front plan view of a wedge connector assembly according to further embodiments of the present invention installed on a pair of electrical conductors.
Figure 8:
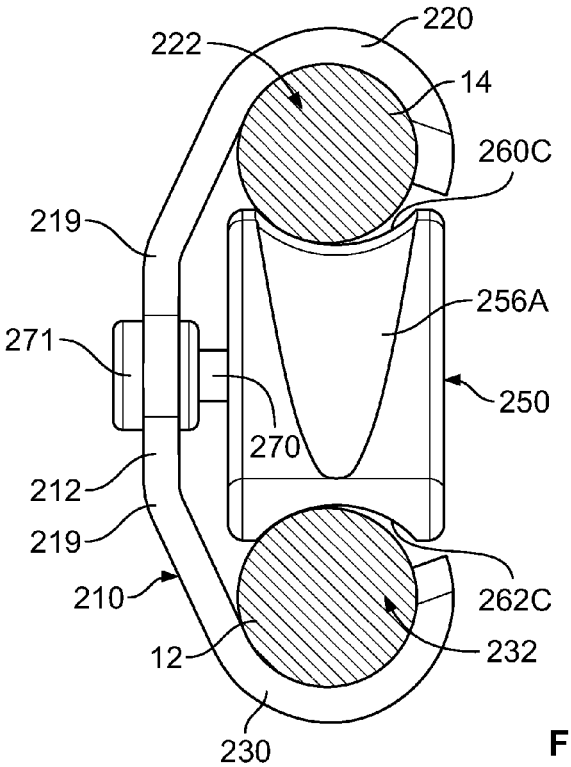
FIG. 8 is a left side elevational view of the wedge connector assembly of FIG. 7 installed on the conductors.

With reference to FIGS. 7 and 8, a connector assembly 200 according to further embodiments of the present invention is shown therein connecting the conductors 12, 14. The connector assembly 200 includes a spring member 210 and the cam wedge member 250 corresponding to the spring member 110 and a cam wedge member 150, respectively. The connector assembly 200 is constructed and operable in the same manner as the connector assembly 100, except as follows.

The spring member 210 has a generally oblong shape. Intermediate bends 219 are provided in the central portion 212 to increase the deflection resistance of the hook portions 220 and 230. According to some embodiments, the bends 219 extend substantially parallel to the lengthwise axes of the channels 222, 232 defined by the hook portions 220, 230.

The cam wedge member 250 has a generally parallelogram shape with opposed top and bottom sides 256 and 257 and opposed first and second ends 260 and 262. Tapered ramp grooves 256A (FIG. 8) and 257A (FIG. 7) are defined in the sides 256 and 257 to guide the conductors 12, 14 into end channels 260C and 262C. The pivot post 270 of the wedge member 250 is retained or secured in the cam slot 240 by a retention head 271.

Figure 9:
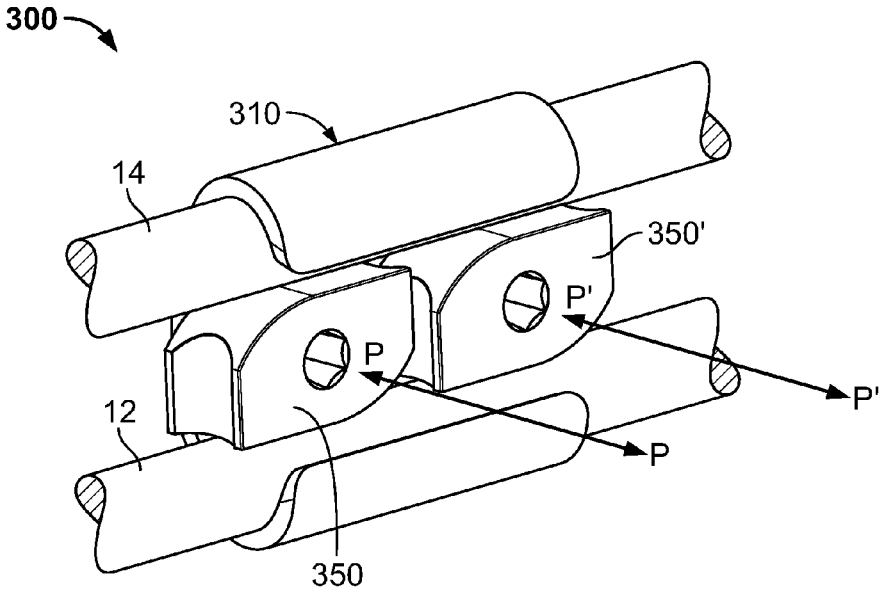
FIG. 9 is a left, front perspective view of a wedge connector assembly according to further embodiments of the present invention partially installed on a pair of electrical conductors.
Figure 10:
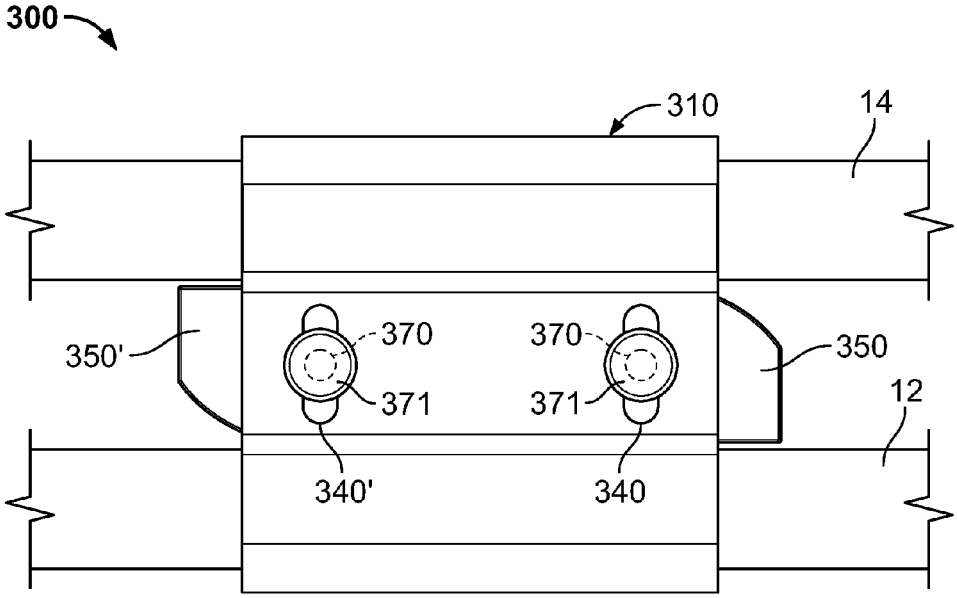
FIG. 10 is a rear plan view of the wedge connector assembly of FIG. 9 partially installed on the conductors.
Figure 11:
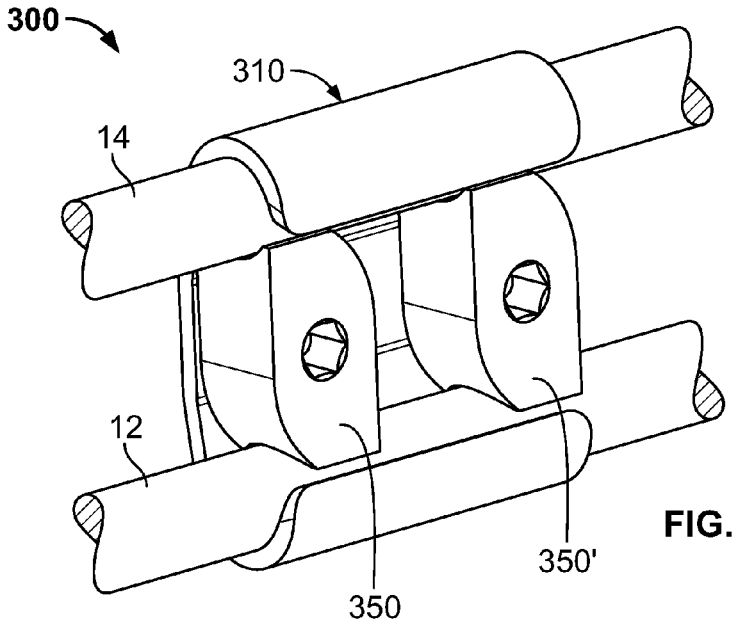
FIG. 11 is a left, front perspective view of the wedge connector assembly of FIG. 9 fully installed on the conductors.

With reference to FIGS. 9-11, a connector assembly 300 according to further embodiments of the present invention is shown therein connecting the conductors 12, 14. The connector assembly 300 is constructed and operable in the same manner as the connector assembly 100, except as follows.

The connector assembly 300 includes a spring member 310, a first cam wedge member 350 and a second cam wedge member 350'. The spring member 310 corresponds to the spring member 110 except that the spring member 310 may be longer and has a pair of cam slots 340, 340'. The first and second cam wedge members 350, 350' each correspond to the cam wedge member 150. The wedge members 350, 350' are provided with retention heads 371 on their pivot posts 370 to lock the wedge members 350, 350' into the cam slots 340, 340' (FIG. 10). The wedge member 350 is rotatable about a rotation axis P-P and the wedge member 350' is rotatable about a rotation axis P'-P' in the same manner as the wedge member 150 between a initial position (FIGS. 9 and 10) and a locking position (FIG. 11). In use, the wedge members 350, 350' can both be rotated to interlock with the conductors 12, 14 as shown in FIG. 11.

A connector assembly having multiple cam wedge members such as the connector assembly 350 may be advantageous in order to accommodate a higher electrical current level and/or to provide greater tensile strength. Three or more cam wedge members may be provided on a single spring member. According to some embodiments, a first cam wedge member on a spring member is configured to be rotated in a first direction (e.g., clockwise) to interlock with the conductors while a second cam wedge member on the same spring member is configured to be rotated in a second direction (e.g., counterclockwise) to interlock with the conductors.

Figure 12:
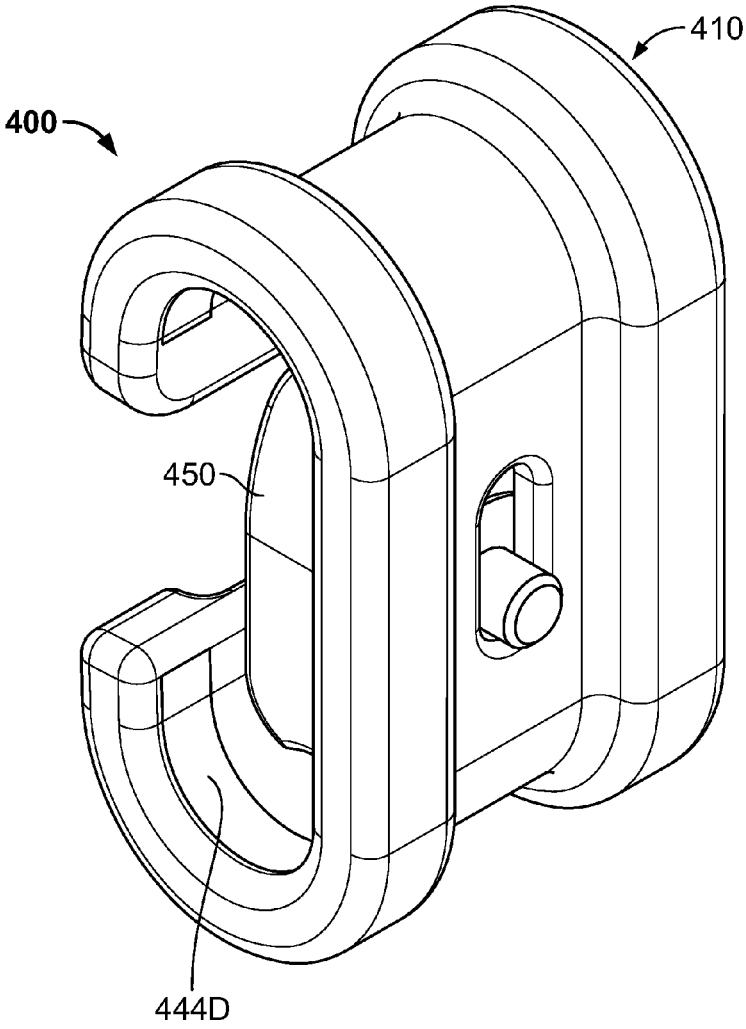
FIG. 12 is a right, rear perspective view of a wedge connector assembly according to further embodiments of the present invention.
Figure 13:
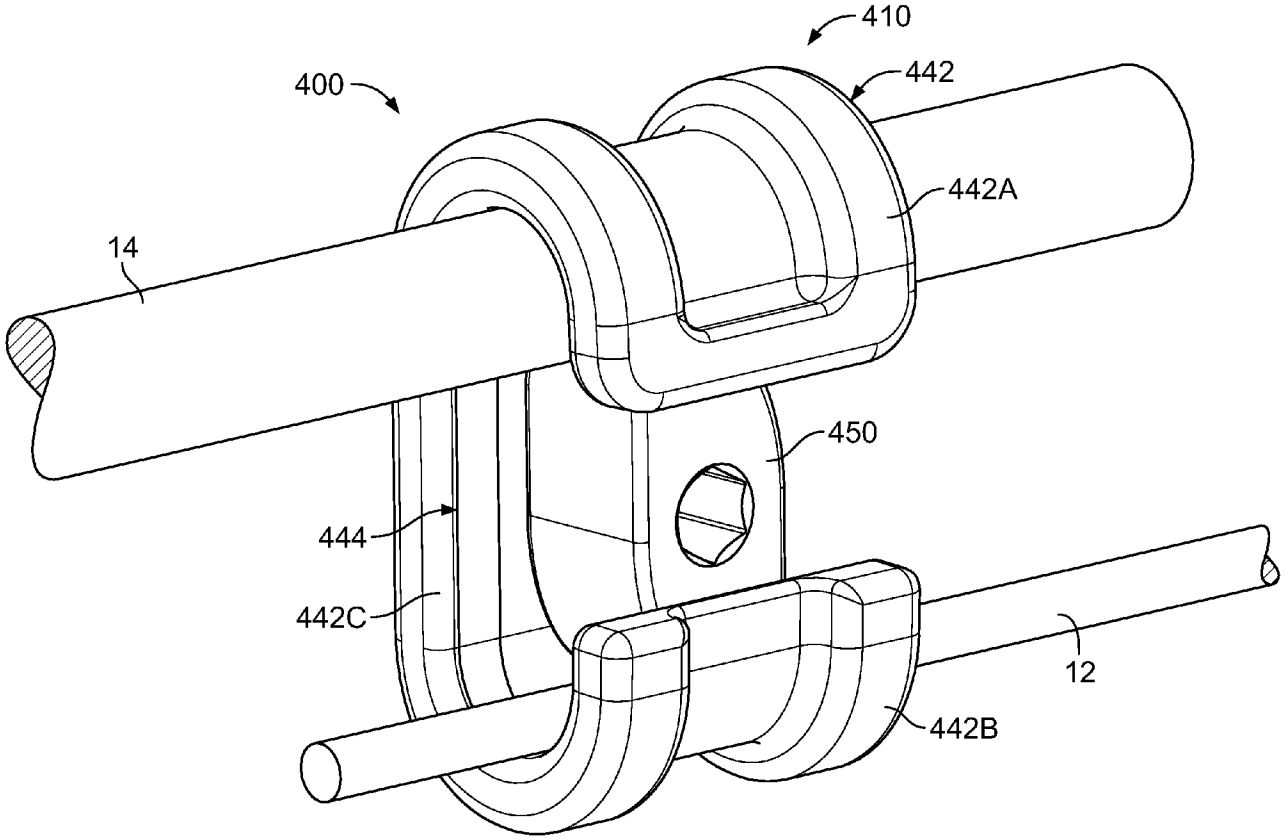
FIG. 13 is a left, front perspective view of the wedge connector assembly of FIG. 12 installed on a pair of electrical conductors.
Figure 14:
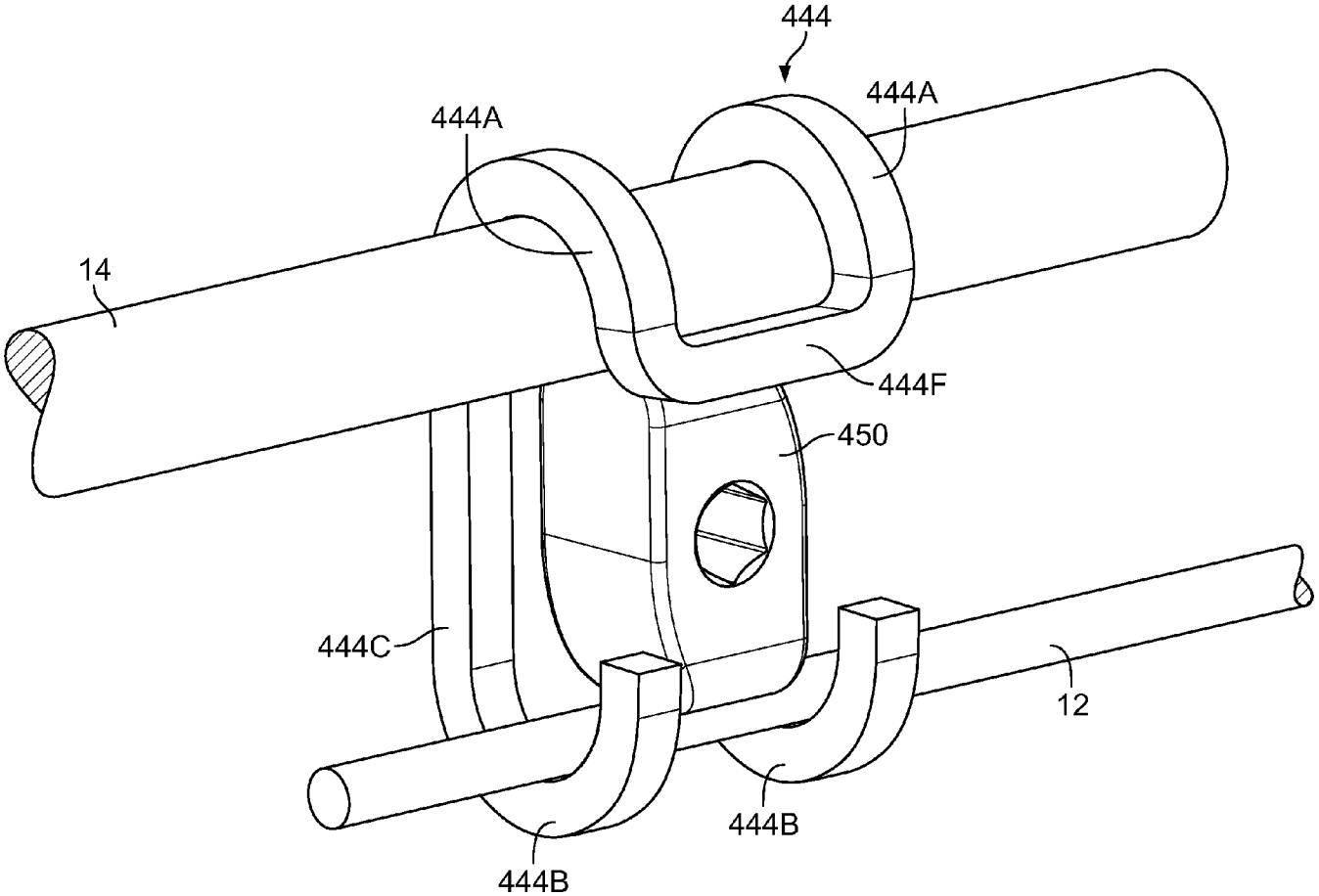
FIG. 14 is a left, front perspective view of the wedge connector assembly of FIG. 12 installed on the conductors, wherein a body of the wedge connector assembly is omitted for the purpose of explanation.

With reference to FIGS. 12-14, a connector assembly 400 according to further embodiments of the present invention is shown therein connecting the conductors 12, 14. The connector assembly 400 is constructed and operable in the same manner as the connector assembly 100, except as follows.

The connector assembly 400 includes a composite or dual component spring member 410 and a cam wedge member 450. The cam wedge member 450 corresponds to the cam wedge member 150.

The composite spring member 410 includes a body 442 (FIG. 13) and a contact member 444 (FIG. 14). In FIG. 14, the connector assembly 400 is shown mounted on the conductors 12, 14 with the body 442 omitted for the purpose of explanation.

The contact member 444 includes hook portions 444A and 444B to receive and engage the conductors 14 and 12 as shown in FIGS. 13 and 14, for example. Flexible connecting portions 444C and 444F connect the hook portions 444A, 444B. The hook portions 444A, 444B are substantially rectangular in cross-section with flat sides 444D forming the contact surfaces that engage the conductors 12, 14.

The contact member 444 is formed of an electrically conductive material (e.g., a material as described above for the spring member 110). In some embodiments, the contact member 444 is formed from a drawn and bent metal wire. In some embodiments, the contact member 444 is monolithic and unitarily formed.

The body 442 includes hook portions 442A and 442B to receive the conductors 14 and 12 as shown in FIG. 13, for example. A flexible connecting portion 442C connects the hook portions 442A, 442B. According to some embodiments, the body 442 is resiliently deflectable.

The body 442 may be formed of any suitable material. According to some embodiments, the body 442 is formed of a polymeric material. In some embodiments, the polymeric material is a nylon PA 6.6. Suitable polymeric materials include polyvinyl chloride (PVC), polycarbonate, polypropylene and ethylene-vinyl acetate (EVA). In some embodiments, the body 442 is monolithic and unitarily formed.

According to some embodiments, the contact member 444 is embedded in the body 442. In some embodiments, the body 442 is overmolded onto the contact member 444.

The body 442 may provide the majority of the elastic, resilient deflection resistance to the spring member 410, and thereby provide a majority of the spring back force. The use of a two part (body 442 and contact member 444) construction can reduce materials and/or manufacturing costs and enable greater design flexibility.

Figure 15:
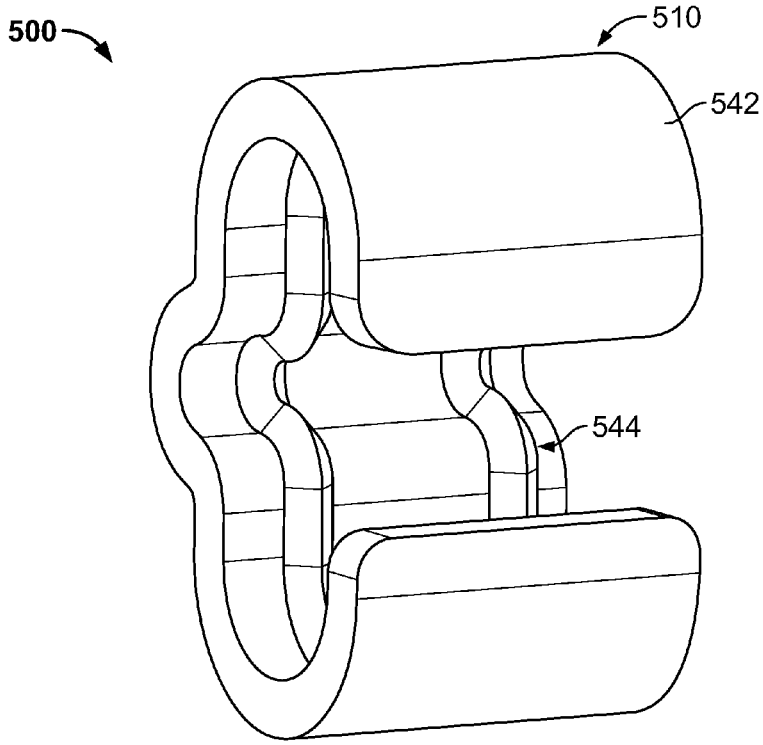
FIG. 15 is a front perspective view of a wedge connector assembly according to further embodiments of the present invention.
Figure 16:
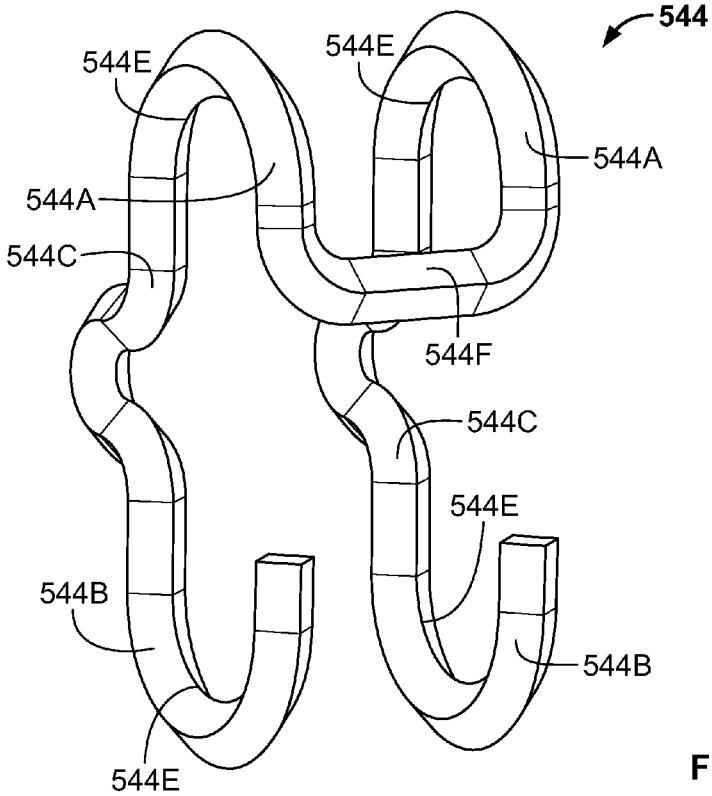
FIG. 16 is a front perspective view of a contact member forming a part of the wedge connector assembly of FIG. 15.

With reference to FIGS. 15 and 16, a connector assembly 500 according to further embodiments of the present invention is shown therein for connecting the conductors 12, 14, for example. The connector assembly 500 is constructed and operable in the same manner as the connector assembly 400, except as follows.

The connector assembly 500 includes a composite spring member 510 and a cam wedge member (not shown) corresponding to the cam wedge member 450.

The composite spring member 510 includes a body 542 (FIG. 15) and a contact member 544 (FIGS. 15 and 16). The body 542 corresponds to the body 442 and the contact member 544 may be embedded in the body 542 in the same manner as described above for the spring member 410.

The contact member 544 has hook portions 544A, 544B and flexible connecting portions 544C, 544F, and corresponds to the contact member 444 except, while also being substantially rectangular in cross-section, sharp corner edges 544E of the contact member 544 form the contact surfaces that engage the conductors 12, 14.

Figure 17:
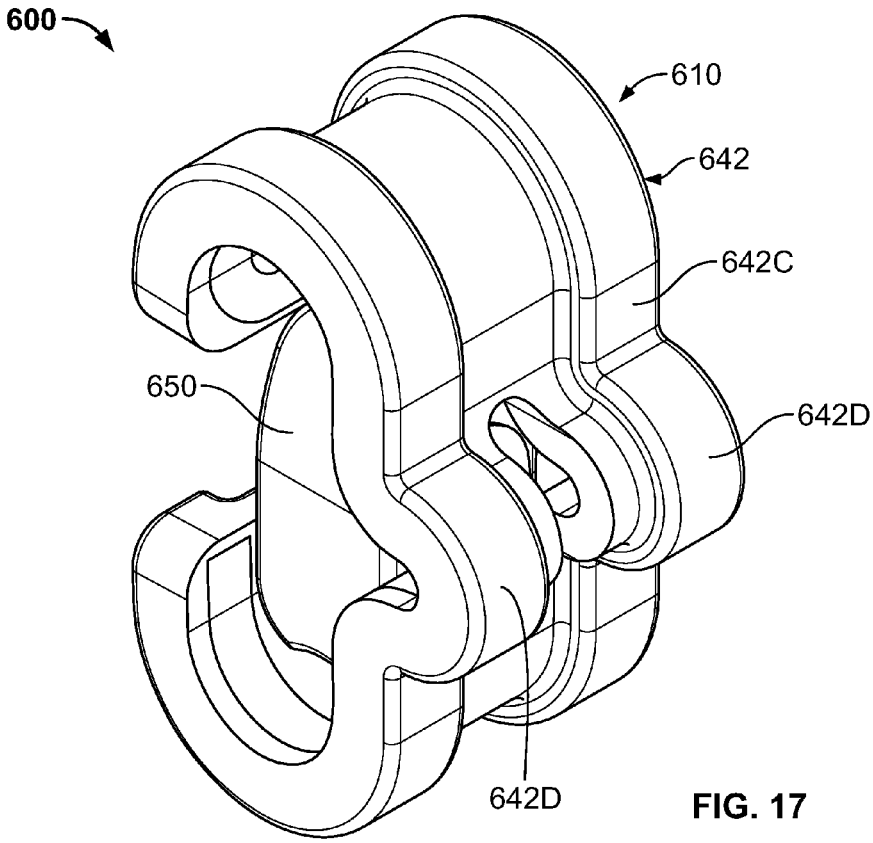
FIG. 17 is a rear perspective view of a wedge connector assembly according to further embodiments of the present invention.
Figure 18:
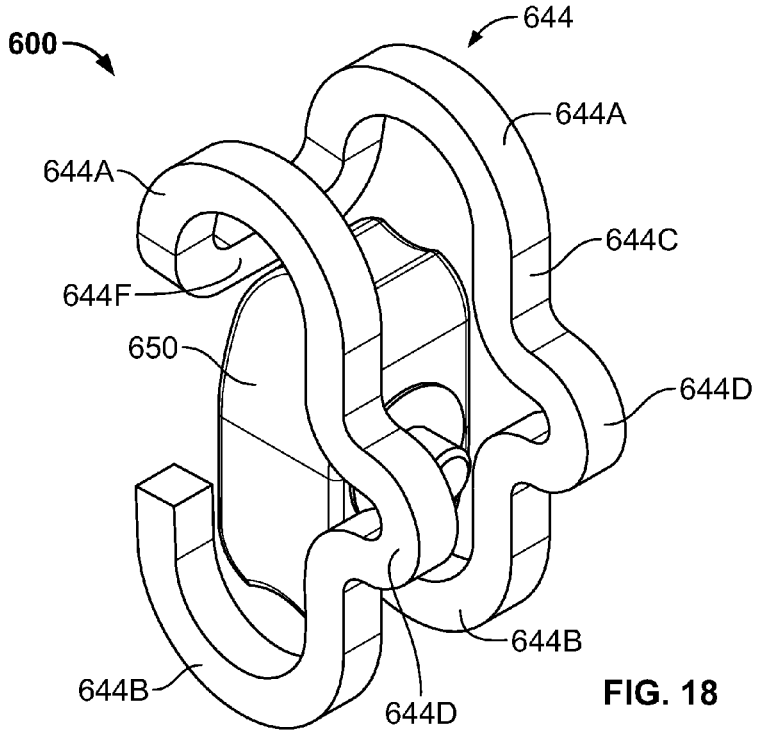
FIG. 18 is a rear perspective view of a contact member and a cam wedge member forming a part of the wedge connector assembly of FIG. 17.

With reference to FIGS. 17 and 18, a connector assembly 600 according to further embodiments of the present invention is shown therein for connecting the conductors 12, 14, for example. The connector assembly 600 is constructed and operable in the same manner as the connector assembly 400, except that the contact member 642 (which has hook portions 644A, 644B and flexible connecting portions 644C, 644F and body 644 of the composite spring member 610 have intermediate or supplemental bends or elbows 642D and 644D, respectively, in their connecting portions 642C, 644C. The supplemental bends 642D, 644D may be provided to tune or set the deflection response of the spring member 610.

Figure 19:
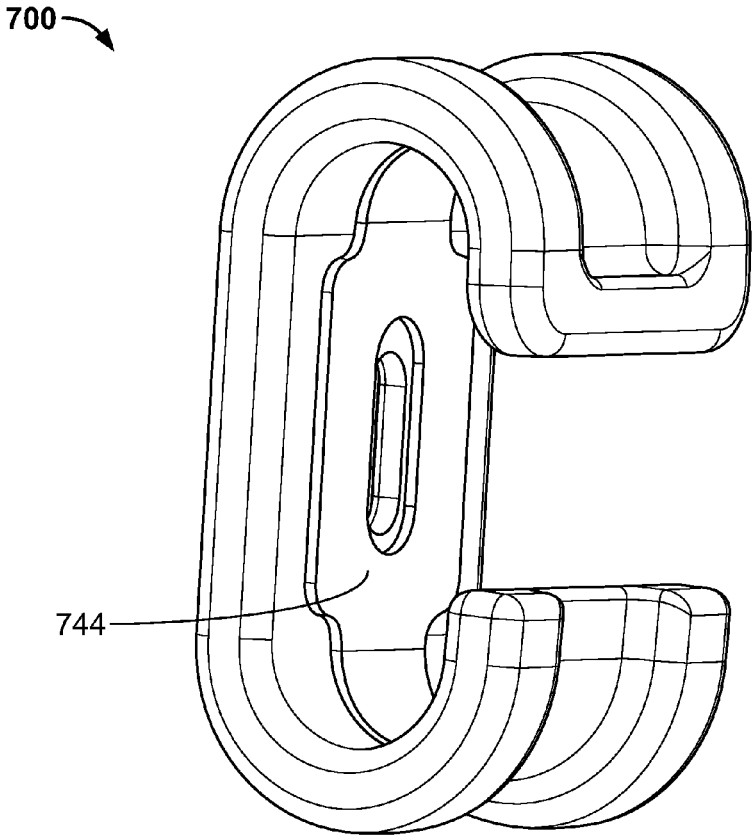
FIG. 19 is a front perspective view of a wedge connector assembly according to further embodiments of the present invention.
Figure 20:
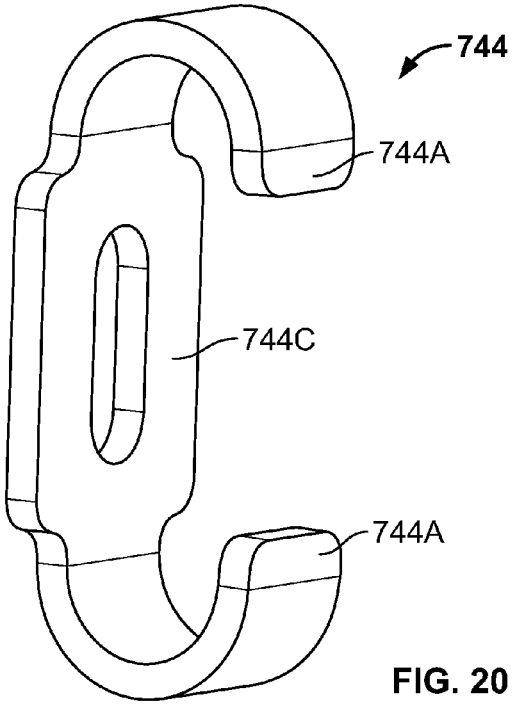
FIG. 20 is a front perspective view of a contact member forming a part of the wedge connector assembly of FIG. 19.

With reference to FIGS. 19 and 20, a connector assembly 700 according to further embodiments of the present invention is shown therein for connecting the conductors 12, 14, for example. The connector assembly 700 is constructed and operable in the same manner as the connector assembly 400, except that a contact member 744 is provided in place of the contact member 444. The contact member 744 has hook portions 744A, 744B and a flexible connecting portion 744C in the shape of a plate. The connector assembly 700 also includes a cam wedge member (no shown) corresponding to the cam wedge member 450. The contact member 744 may be formed of the same material(s) as the contact member 444, but has a different configuration. A body 742 corresponding to the body 442 may be overmolded onto the contact member 744.

Figure 21:
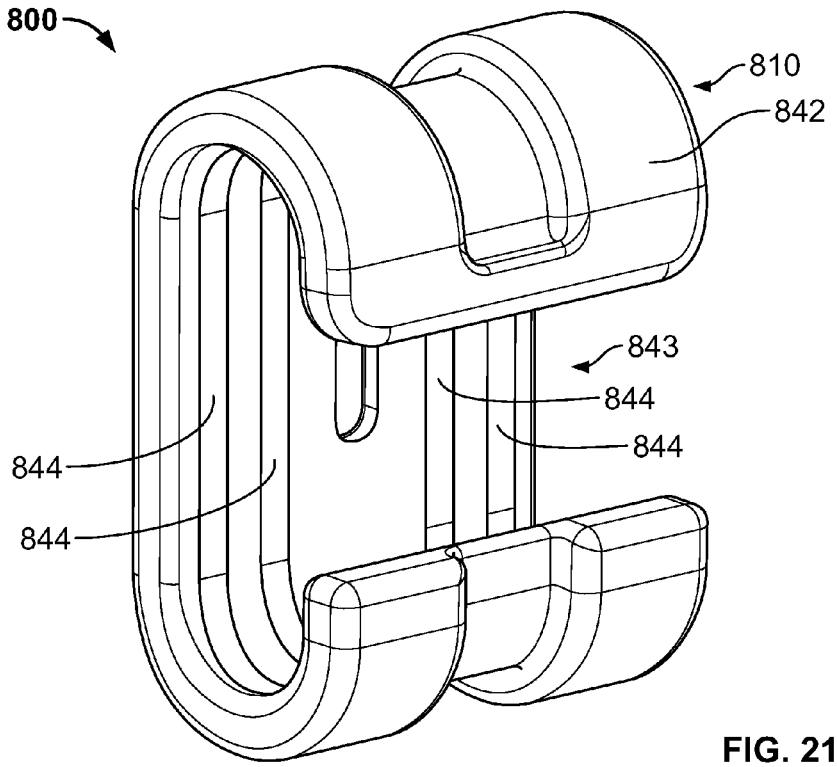
FIG. 21 is a front perspective view of a wedge connector assembly according to further embodiments of the present invention.
Figure 22:
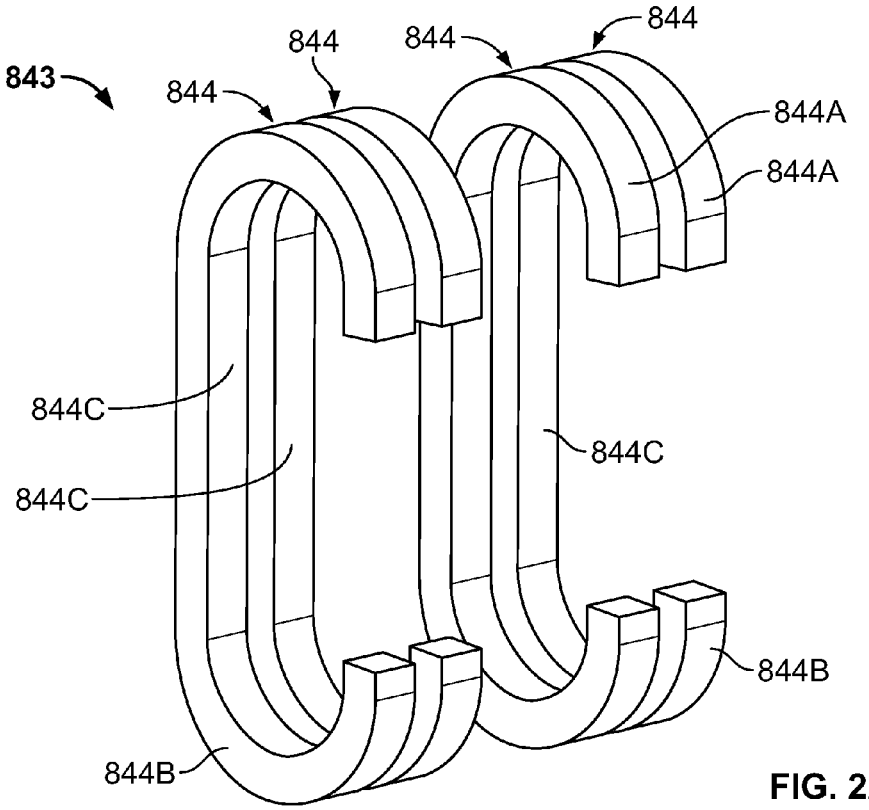
FIG. 22 is a front perspective view of a set of contact members forming a part of the wedge connector assembly of FIG. 21.

With reference to FIGS. 21 and 22, a connector assembly 800 according to further embodiments of the present invention is shown therein for connecting the conductors 12, 14, for example. The connector assembly 800 is constructed and operable in the same manner as the connector assembly 400, except as follows.

The connector assembly 800 includes a composite spring member 810 and a cam wedge member (not shown) corresponding to the cam wedge member 450.

The composite spring member 810 includes a body 842 (FIG. 21) and a set 843 of contact members 844 (FIGS. 21 and 22). The body 842 corresponds to the body 442 and each of the contact members 844 may be embedded in the body 842 in the same manner as described above for the spring member 410.

The set 843 of contact members 844 corresponds to the contact member 444 except that the contact members 844 are discrete components from one another (i.e., are not joined by a connecting portion corresponding to the connecting portion 444F). Each contact member 844 has hook portions 844A, 844B joined by a flexible connecting portion 844C. The contact members 844 may each independently provide the contact surfaces that engage each of the conductors 12, 14 and thereby provide electrical continuity between the conductors 12, 14. In the illustrated embodiment, four contact members 844 are mounted in the body 842. However, in other embodiments, more or fewer contact members 844 may be provided.

The contact member set 843 may reduce the amount of raw material (metal), and corresponding cost required to construct the connector assembly 800.

The cam wedge members of the aforedescribed connector assemblies 100, 200, 300, 400, 500, 600, 700, 800 may be removable from their associated spring members. That is, the pivot posts thereof may be removably mounted in the corresponding cam slots. Alternatively, a retention head corresponding to the retention head 271 (FIG. 8) may be provided to secured the wedge members in their cam slots.

In some embodiments, the cam wedge member may be secured to the spring member by a feature other than an integral retention head such as the retention head 271. For example, the cam wedge member may be secured or locked onto to the spring member by a rivet.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A wedge connector assembly for forming an electrical connection with an elongate electrical conductor, the wedge connector assembly comprising:

a resilient spring member defining a spring member channel, the spring member channel having a spring member channel axis and being configured to receive the electrical conductor such that the electrical conductor extends along the spring member channel axis;

a first cam wedge member mounted on the spring member such that the first cam wedge member is rotatable relative to the spring member about a first pivot axis to a first locking position wherein the first cam wedge member captures the electrical conductor in the spring member channel and elastically deflects the spring member; and a second cam wedge member mounted on the spring member, wherein the second cam wedge member is rotatable about a second pivot axis to a second locking position wherein the second cam wedge member captures the electrical conductor in the spring member channel and elastically deflects the spring member.

2. The wedge connector assembly of claim 1 wherein the first and second pivot axes are transverse to the spring member channel axis.

3. The wedge connector assembly of claim 2 wherein the first and second pivot axes are substantially perpendicular to the spring member channel axis.

4. The wedge connector assembly of claim 1 wherein:

the spring member defines a second spring member channel opposite the first spring member channel, the second spring member channel having a second spring member channel axis and being configured to receive an elongate second electrical conductor such that the second electrical conductor extends along the second spring member channel axis;

when the first cam wedge member is in the first locking position, the first cam wedge member simultaneously captures the first electrical conductor in the first spring member channel and the second electrical conductor in the second spring member channel; and when the second cam wedge member is in the second locking position, the second cam wedge member simultaneously captures the first electrical conductor in the first spring member channel and the second electrical conductor in the second spring member channel.

5. The wedge connector assembly of claim 1 wherein the first cam wedge member includes:

an end side that engages the electrical conductor in the first locking position; and a ramp surface that engages and displaces the electrical conductor as the first cam wedge member is rotated about the first pivot axis to the first locking position.

6. The wedge connector assembly of claim 5 wherein the ramp surface defines a tapered ramp groove.

7. The wedge connector assembly of claim 1 wherein the location of the first pivot axis is movable relative to the spring member.

8. The wedge connector assembly of claim 7 including a cam slot defined in the spring member, wherein the first cam wedge member is slidably mounted in the cam slot to permit relocation of the first pivot axis.

9. The wedge connector assembly of claim 8 including a retention feature that prevents removal of the first cam wedge member from the cam slot.

10. The wedge connector assembly of claim 1 wherein the first cam wedge member includes a driver engagement feature configured to receive a driver to forcibly rotate the first cam wedge member about the first pivot axis into the first locking position.

11. The wedge connector assembly of claim 1 wherein the spring member is a composite spring member including:

a resilient body; and an electrically conductive contact member mounted on the body and configured to engage the electrical conductor for electrical contact therewith.

12. The wedge connector assembly of claim 11 wherein:

the body is formed of a polymeric material; and the contact member is formed of metal.

13. The wedge connector assembly of claim 12 wherein the body is overmolded onto the contact member.

14. The wedge connector assembly of claim 12 wherein the contact member is formed of a curved wire.

15. The wedge connector assembly of claim 14 wherein the curved wire has a substantially sharp contact surface that engages the electrical conductor when the first cam wedge member is in the first locking position.

16. The wedge connector assembly of claim 11 including at least two discrete electrically conductive contact members mounted on the body, each of the contact members being configured to engage the electrical conductor for electrical contact therewith.

17. The wedge connector assembly of claim 1 including a supplemental bend in spring member, wherein the supplemental bend extends substantially parallel to the spring member channel axis.

18. A method for forming an electrical connection with an elongate electrical conductor, the method comprising:

providing a wedge connector assembly including:

a resilient spring member defining a spring member channel, the spring member channel having a spring member channel axis; and a first cam wedge member mounted on the spring member such that the first cam wedge member is rotatable relative to the spring member about a first pivot axis;

mounting the electrical conductor in the spring member channel such that the electrical conductor extends along the spring member channel axis;

rotating the first cam wedge member about the first pivot axis to a first locking position wherein the first cam wedge member captures the electrical conductor in the spring member channel and elastically deflects the spring member; and rotating a second cam wedge member about a second pivot axis to a second locking position wherein the second cam wedge member captures the electrical conductor in the spring member channel and elastically deflects the spring member.

19. An electrical connection comprising:

a wedge connector assembly comprising:

a resilient spring member defining a spring member channel, the spring member channel having a spring member channel axis;

a first cam wedge member mounted on the spring member such that the first cam wedge member is rotatable relative to the spring member about a first pivot axis; and a second cam wedge member mounted on the spring member such that the second cam wedge member is rotatable relative to the spring member about a second pivot axis; and an elongate electrical conductor received in the spring member channel and extending along the spring member channel axis;

wherein the first cam wedge member is rotated about the first pivot axis to a first locking position wherein the first cam wedge member captures the electrical conductor in the spring member channel and elastically deflects the spring member; and wherein the second cam wedge member is rotated about the second pivot axis to a second locking position wherein the second cam wedge member captures the electrical conductor in the spring member channel and elastically deflects the spring member.

* * * * *